US012685425B2

(12) United States Patent
Tyroler

(10) Patent No.: US 12,685,425 B2
(45) Date of Patent: Jul. 21, 2026

(54) BROOM WITH A FINE DUST SWEEPING ELEMENT

(71) Applicant: TYROLER LTD., Neve Yamin (IL)

(72) Inventor: Dan Tyroler, Yesod HaMa'ala (IL)

(73) Assignee: TYROLER LTD., Neve Yamin (IL)

( * ) Notice: Subject to any disclaimer, the term of this patent is extended or adjusted under 35 U.S.C. 154(b) by 318 days.

(21) Appl. No.: 18/577,967

(22) PCT Filed: Jul. 10, 2022

(86) PCT No.: PCT/IL2022/050741
§ 371 (c)(1),
(2) Date: Jan. 9, 2024

(87) PCT Pub. No.: WO2023/286051
PCT Pub. Date: Jan. 19, 2023

(65) Prior Publication Data

US 2024/0306877 A1 Sep. 19, 2024

(30) Foreign Application Priority Data

Jul. 11, 2021 (IL) ..... 284754

(51) Int. Cl.
*A47L 13/12* (2006.01)

(52) U.S. Cl.
CPC ..... *A47L 13/12* (2013.01)

(58) Field of Classification Search
CPC ..... A46B 2200/302; A46B 3/005; A46B 1/00; A46B 15/0081; A47L 13/12
See application file for complete search history.

(56) References Cited

U.S. PATENT DOCUMENTS

D278,099 S 3/1985 Evans
D285,736 S 9/1986 Seely
(Continued)

FOREIGN PATENT DOCUMENTS

CA 2206187 A1 * 11/1997 ..... A47L 13/12
CN 110893087 A * 3/2020 ..... A47L 13/26
(Continued)

OTHER PUBLICATIONS

"Vileda DuActiva 2 in1 Broom", Vileda Australia, retrieved from: https://www.youtube.com/watch?v=FYY35ALDNS0&ab (Published: Jun. 27, 2014).
(Continued)

*Primary Examiner* — Shay Karls
(74) *Attorney, Agent, or Firm* — Maschoff Brennan

(57) ABSTRACT

The present disclosure provides a broom, specifically a broom head that is made of a single mold and therefore is a single-piece molded article. The broom includes a base member having two opposite faces, a bottom face and a top face. The base member is elongated along a longitudinal direction between first and second ends. An array of bristles intended to perform the sweeping activity protrudes from the bottom face and a rod receptacle configured to receive a rod for handling the broom protrudes from the top face. Each of the bristles of the array is spaced apart from any other bristle. To facilitate utilizing the broom also to sweep small particles, the broom further includes a fine dust sweeping element that protrudes from the bottom face, typically from an edge of the base member extending between the first and second ends.

12 Claims, 2 Drawing Sheets

(56) References Cited

U.S. PATENT DOCUMENTS

| | | | | |
|---|---|---|---|---|
| D306,506 | S | 3/1990 | Houser | |
| D307,517 | S | 5/1990 | Mallory | |
| 4,991,246 | A | 2/1991 | Decicco | |
| 5,072,479 | A | 12/1991 | Van Niekerk | |
| 5,319,823 | A | 6/1994 | Baum | |
| D368,346 | S | 3/1996 | Kiefer | |
| D373,024 | S | 8/1996 | Shepherd | |
| D375,409 | S | 11/1996 | Uranga | |
| D511,046 | S | 11/2005 | Berti | |
| D585,614 | S | 1/2009 | Senyuva | |
| D648,498 | S | 11/2011 | Rossano | |
| 9,375,076 | B2 * | 6/2016 | Weis | A46B 9/04 |
| D826,499 | S | 8/2018 | Larouche | |
| D897,690 | S | 10/2020 | Carrière | |
| D970,139 | S | 11/2022 | Tyroler | |
| 2002/0124341 | A1 | 9/2002 | Cesak | |
| 2017/0100012 | A1 | 4/2017 | Tyroler | |
| 2020/0281435 | A1 | 9/2020 | Ting | |
| 2024/0306877 | A1 | 9/2024 | Tyroler | |

FOREIGN PATENT DOCUMENTS

| | | | |
|---|---|---|---|
| CN | 211408922 | U | 9/2020 |
| CN | 218279538 | U | 1/2023 |
| EP | 0809964 | A2 | 12/1997 |
| EP | 2 138 084 | A2 | 12/2009 |
| WO | 9633648 | A1 | 10/1996 |
| WO | 2016038400 | A1 | 3/2016 |

OTHER PUBLICATIONS

"Tyroler | 2-in-1 Rubber Broom", Grommet, retrieved from: https://www.youtube.com/watch?v=kAIKw4-2bkQ&ab (Published: Jun. 8, 2019).

* cited by examiner

BROOM WITH A FINE DUST SWEEPING ELEMENT

TECHNOLOGICAL FIELD

The present disclosure is in the field of household cleaning tools.

BACKGROUND ART

References considered to be relevant as background to the presently disclosed subject matter are listed below:

https://www.youtube.com/watch?v=FYY35AL-DNS0&ab_channel=ViledaAaustralia;

https://www.youtube.com/watch?v=kAIKw4-2bkQ&ab_channel=Grommet

Acknowledgement of the above references herein is not to be inferred as meaning that these are in any way relevant to the patentability of the presently disclosed subject matter.

GENERAL DESCRIPTION

The present disclosure provides a broom, specifically a broom head that is made of a single mold and therefore is a single-piece molded article. The broom includes a base member having two opposite faces, a bottom face and a top face. The base member is elongated along a longitudinal direction between first and second ends. An array of bristles intended to perform the sweeping activity protrudes from the bottom face and a rod receptacle configured to receive a rod for handling the broom protrudes from the top face. Each of the bristles of the array is spaced apart from any other bristle. To facilitate utilizing the broom also to sweep small particles, the broom further includes a fine dust sweeping element that protrudes from the bottom face, typically from an edge of the base member extending between the first and second ends. The fine dust sweeping element comprising a continuous Sweeping edge distal to the bottom face which is designed to lie on a similar plane on which the edges of the bristles lie on or on a parallel plane spanned between the plane of the edge of the bristles and a plane defined by the bottom face. Thus, by manipulating the broom with the rod, the user can selectively control to engage the sweeping edge with the surface to be swept or to avoid said engagement of the sweeping edge and merely sweep the surface with the array of bristles. It is to be noted that the engagement of the sweeping edge with the surface to be swept occurs simultaneously to the engagement of at least some of the bristles of the array, or at times simultaneously to the engagement of all the bristles of the array. Therefore, the broom of the present disclosure provides a solution to handle coarse and fine particles to be swept from a surface. The base member, the bristles array, the rod receptacle, and the fine dust sweeping element are all integrally formed due to the single mold they are made from and are made of silicone or silicone rubber giving the broom unique and advantageous characteristics.

Thus, a first aspect of the present disclosure provides a broom head (or in short "a broom"). The broom comprising an elongated base member extending between first and second long ends and defining a base width. The base member is having first, top, and second, bottom, faces and defining a base member plane. A rod receptacle arrangement is formed on or attached to the first face, typically at a mid-portion of the first face, and is configured to receive a rod or a handle to manipulate the broom.

An array of bristles protruding from a bristle support portion of the second, bottom face. The bristle support portion constituting a major portion of the bottom face, extending along at least the majority of the length between the first and second ends and a portion of the base width. Distal edges of the bristles defining a bristles plane parallel to the base member plane lower than said edge line.

An array of bristles protrudes from the second face, namely a plurality of brushing elements, such that each bristle is spaced apart from any other bristle. The array is defined along the majority of the length between the first and second long ends and a portion of the base width. Thus, the array is defined along above half of the length, typically above three quarters of the length and in some embodiments, it is defined along the entire length between the first and second ends. Distal edges of the bristles define a bristles plane parallel to the base member plane.

A fine dust sweeping element protrudes or extends downwardly from the second face and comprises a continuous sweeping edge spanning at least the majority of the length between the first and second ends. The continuous sweeping edge defines an edge line normal to the rod axis the base member plane. The sweeping edge has a continuous profile, unlike the discontinuous profile of the array of bristles that are space apart one from the other. The sweeping edge is the edge distal to the second base and is defined between the base member plane and the bristles plane more proximal to the bristles plane than the base member plane. Namely, the fine dust sweeping element protrudes from the second face to an extent greater than half of the length between the base member plane and the bristles plane, but not reaching the bristles plane.

The sweeping edge and the array of bristles are designed to simultaneously engage a surface to be swept upon standard use of the broom by a user, namely, during a standard sweeping activity, in which the base member plane forms a certain angle with the surface to be swept by user standard manipulation of the rod.

The base member, the array of bristles and the fine dust sweeping element are a single-piece molded article.

In some embodiments of the broom, at least some of the bristles array, e.g. a central group In some embodiments of the broom, the rod receptacle arrangement is also a part of the single-piece molded article. Namely, the rod receptacle arrangement is integral with the base member, the array of bristles and the fine dust sweeping element as it is being made of a single mold.

In some embodiments of the broom, the single-piece molded article is made of an elastomeric material.

In some embodiments of the broom, the elastomeric material is selected from rubber or silicone rubber.

In some embodiments of the broom, the single-piece molded article is made of thermosetting polymers.

In some embodiments of the broom, the fine dust sweeping element protrudes from a longitudinal edge of the base member to be disposed separated from the array of bristles. Therefore, the sweeping edge can be the first element of the broom that meets the objects/particle to be cleaned, at least when positioning the broom in a certain orientation, i.e. a sweeping angle.

In some embodiments of the broom, the sweeping edge line is in a sweeping edge plane that is parallel to the base member plane and the bristles plane and defined therebetween.

In some embodiments of the broom, the first distance between the base member plane and the sweeping edge line or plane is greater than the half of a second distance between the base member plane and the bristles plane. In some embodiments, the first distance is greater than 70% of the second distance and less than 95% thereof.

In some embodiments of the broom, the bristles have a typical vertical length. The typical length is the average length of the bristles or the length of most of the bristles The fine dust sweeping element has a fine dust sweeping element length shorter than the typical length and longer than half of the typical length to allow engagement of the sweeping edge with the surface to be cleaned/brushed, therefore allowing to sweep small particles, e.g. sand particles.

In some embodiments of the broom, the fine dust sweeping element length is between 70% and 95% of the typical length.

In some embodiments of the broom, the rod receptacle arrangement defines a rod receptacle axis that is tilted with respect to the base member plane thus forming an angle of the rod that is received in the rod receptacle such that the rod tilts to one side for allowing easy utilization of the broom.

In some embodiments of the broom, the rod receptacle arrangement is pivotable about an axis that is parallel to the base member plane to allow a change of an angle between the rod receptacle axis and the base member plane.

In some embodiments, the broom comprising two fine dust sweeping elements, each protrudes from a different edge of the base member, therefore allowing two-sides utilization of the broom.

In some embodiments of the broom, the fine dust sweeping element is planar and defining a fine dust sweeping element plane about normal to the base member plane.

It is to be understood that the term "about" should be interpreted as ±20° from normal, namely at the range of 70°-110° with respect to a selected angle that is formed between the planes.

In some embodiments of the broom, the thickness of the fine dust sweeping element is equal or smaller than that of the diameter of the bristles.

In some embodiments of the broom, the sweeping element plane is parallel to at least some of the bristles.

In some embodiments of the broom, the end bristles proximal to the first and second end are angled with respect to other bristles in said array.

In some embodiments of the broom, the fine dust element is at a front side of the broom head and defines downwardly extending plane with side element edges. When viewing in a front view of the broom head a majority of the bristles of said array are formed behind said downwardly extending plane, and said end bristles extend laterally beyond said side element edges.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 1A is a perspective view showing the broom from the fine dust sweeping element side: FIG. 1B is a front view of the broom; FIG. 1C is a side view of the broom: FIG. 1D is a perspective view of the broom from the opposite side of the fine dust sweeping element.

DETAILED DESCRIPTION

The following figures are provided to exemplify embodiments and realization of the invention of the present disclosure.

Figure 1A:
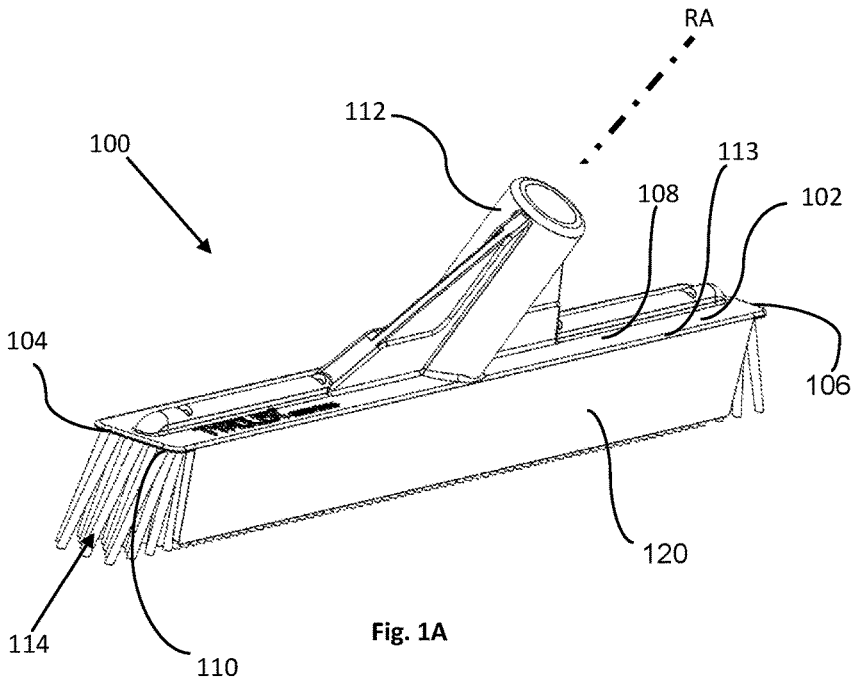
FIGS. 1A-1D are schematic illustrations of different views of a non-limiting embodiment of a broom according to an aspect of the present disclosure.
Figure 1B:
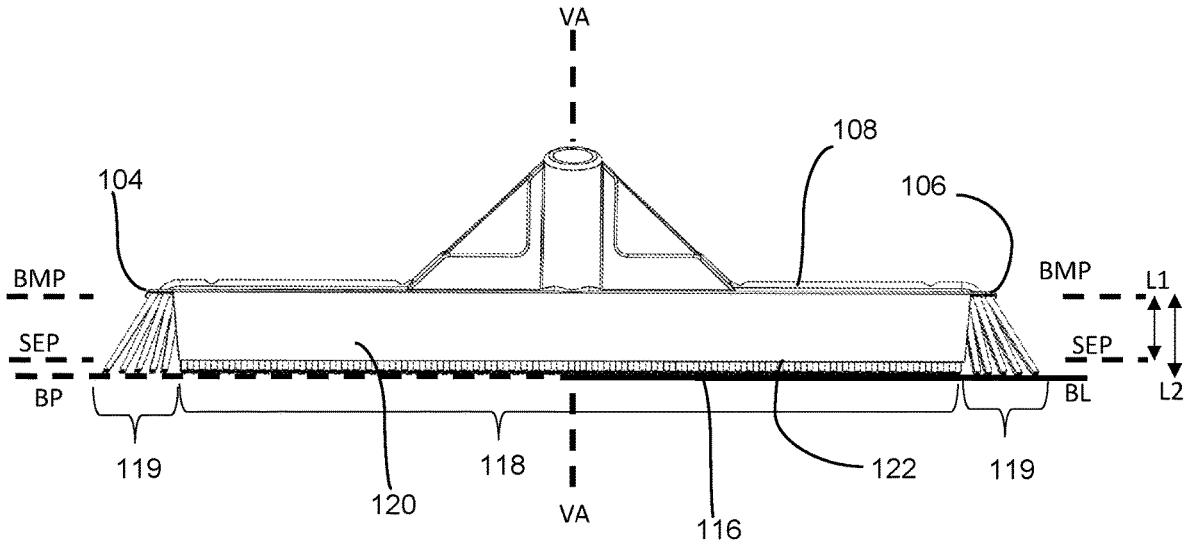
Figure 1C:
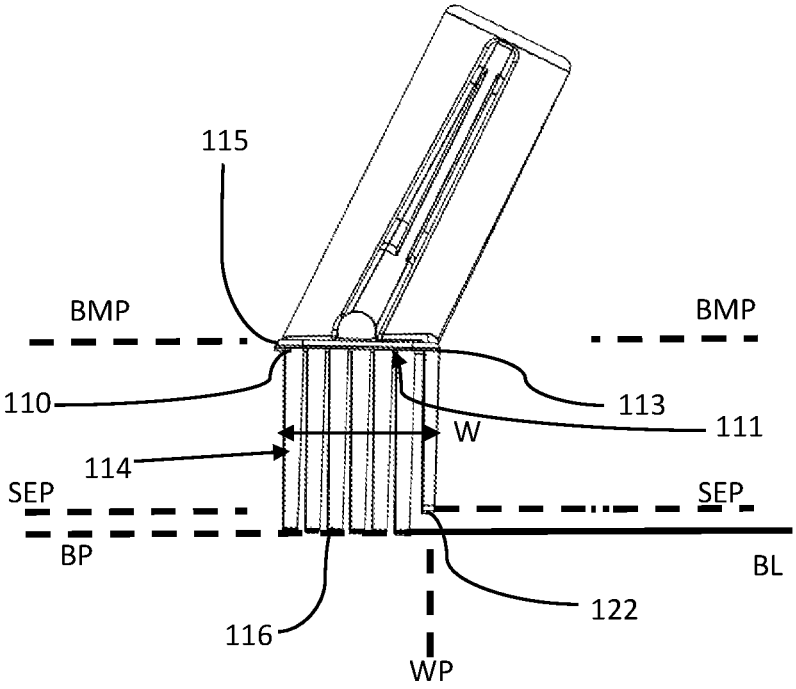
Figure 1D:
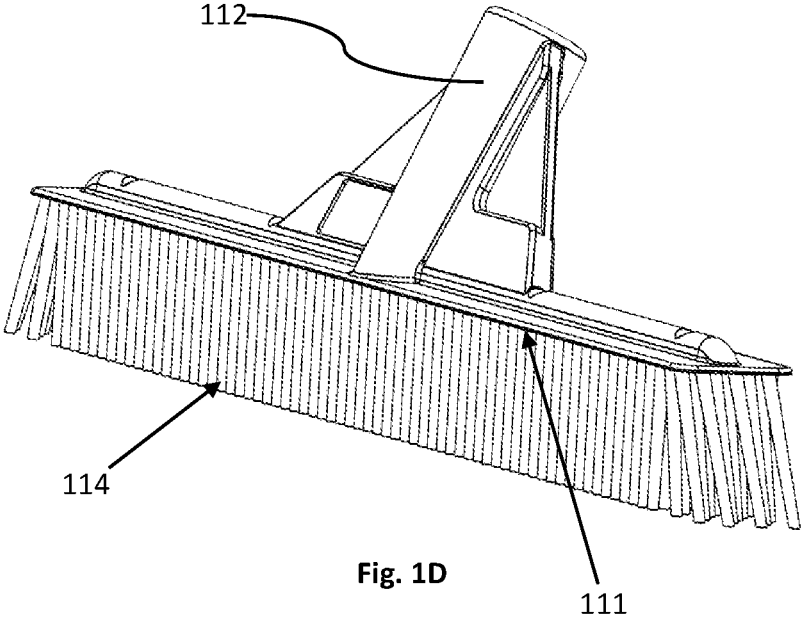

Reference is being made to FIGS. 1A-1D, which are schematic illustrations of different views of a non-limiting example of the broom according to an aspect of the present disclosure. The broom 100 includes an elongated base member 102 extending between first and second ends 104 and 106 and having a certain base width W. The base defines a base member plane BP and includes a first, top face 108 and a second, bottom face 110. A rod receptacle 112 protrudes from the first face 108 and defines a rod receptacle axis RA that forms an acute angle $\alpha$ with the base member plane BP such that at least a portion of the 2-dimensional projection of the rod receptacle 112 does not overlap with the base member 102. In other words, the rod receptacle 112 is tilted with respect to the base member 102 towards a first edge thereof 113.

A bristles array 114 protrudes from a bristle support portion 111 on the second, bottom face 110 of the base member 102, such that each bristle extends between the second face 110 and a respective bristle edge 116. The bristle edges 116 define together a bristles line BL that is defined in a bristle plane BP that is parallel to the base member plane BMP. The bristles array 114 includes a central bristles group 118 and two flanking bristles groups 120 at both sides of the central bristles group 118. The central bristles group 118 consists of parallel bristles having directionality normal to the base member plane BMP. The flanking bristles groups 119 consist of bristles forming different angles with respect to the base member plane BMP. The vertical length, i.e. the length along the axis normal to the base member plane BMP, of the bristles of the central group and the flanking groups is substantially equal. The term "substantially" should be understood as a deviation of up to +10%, at times up to 5%, 4%, 3%, 2% or up to 1%. This means that the absolute length of the bristles of the flanking groups is greater than the length of the bristles of the central group.

A planar fine dust sweeping element 120 protrudes from the first edge 113 of the second face 110 and defining a fine dust sweeping element plane FSP normal to the base member plane BMP and the bristles plane BP. In other words, the fine dust sweeping element plane FSP is parallel to the directionality defined by the bristles of the central bristles group 118. Thus, the bristles array 114 protrudes from the second face within the boundaries defined by the first and second ends 104 and 106 along the longitudinal dimension of the base member, and by the planar fine dust sweeping element and a second edge 115 of the base member along the transverse dimension of the base member. The planar fine dust sweeping element 120 extends between the second face 110 and a sweeping edge 122. The sweeping edge 122 is continuous and it lies on a sweeping edge plane SEP that is parallel to the base member plane BMP and the bristles plane BP. The fine dust sweeping element 120 extends along a first vertical length L1, namely the vertical length between the second face and the sweeping edge 122. The base member plane BMP and the bristles plane BP are distanced at a second vertical length L2. The vertical length is along a vertical axis VA that is normal to the base member plane BMP. The first vertical length L1 is shorter than the second vertical length L2 in a manner allowing the following: (i) sweeping a surface with the bristles array without the sweeping edge engaging the surface, when the base member plane is oriented at a first range of angles with respect to the surface; and (ii) sweeping a surface with the sweeping edge and optionally some of the bristles engaging the surface, when the base member plane is oriented at a second range of angles with respect to the surface. In other words, the configuration of the broom of the present disclosure allows to perform standard sweeping activity with the bristles array and in case there is a necessity to sweep small particles, the continuous sweeping edge of the planar fine dust sweeping element engages the surface to be cleaned to facilitate the sweeping of said small particles.

Thus, the first vertical length L1 is designed to be between 3-15% shorter than the second vertical length L2.

The base member 102, the rod receptacle 112, the bristles array 114 and the planar fine dust sweeping element 120 are integral with another and they are all a single-piece molded article made from a single mold. Furthermore, the single-piece molded article that includes the base member 102, the rod receptacle 112, the bristles array 114 and the planar fine dust sweeping element 120 is made of rubber or silicone rubber. This provides the broom with unique characteristics and significantly improve the performance thereof with respect to other known brooms in the art.

The invention claimed is:

1. A broom head, comprising:

an elongated base member extending between first and second ends and defining a base member plane with a base width and top and bottom faces;

a rod receptacle arrangement formed on or attached to the top face and configured to receive a rod end portion along a rod axis;

a fine dust sweeping element extending downwards from the second face to a continuous sweeping edge defining a sweeping edge line normal to the rod axis the base member plane spanning at least the majority of the length between the first and second ends, the sweeping edge is defined between the base member plane and the bristles plane, wherein the fine dust sweeping element extends downward from a longitudinal edge of the base member; and an array of bristles protruding from a bristle support portion of the bottom face, said bristle support portion constituting a major portion of the bottom face, distal edges of the bristles defining a bristles plane parallel to the base member plane lower than said sweeping edge line;

wherein the base member, the array of bristles and the fine dust sweeping element are a single-piece molded article;

wherein the rod receptacle arrangement is tilted with respect to the base member plane toward the longitudinal edge from which the fine dust sweeping element extends;

wherein the fine dust sweeping element is disposed separated from the array of bristles, such that the continuous sweeping edge is the first element of the broom head to meet objects on a surface to be swept, at least when the broom head is positioned at a sweeping angle with respect to said surface.

2. The broom head of claim 1, wherein the single-piece molded article is made of an elastomeric material.

3. The broom head of claim 1, wherein the sweeping edge line is in a plane parallel to and in between the base member plane and the bristles plane.

4. The broom head of claim 3, wherein a first distance between the base member plane and the sweeping edge line is greater than half of a second distance between the base member plane and the bristles plane.

5. The broom head of claim 1, wherein the bristles have a typical length, shorter than double an edge distance defined between the bottom face and said sweeping edge line.

6. The broom head of claim 5, wherein said edge distance is between 70% and 95% of said typical length.

7. The broom head of claim 1, wherein the rod receptacle arrangement is part of the single-piece molded article.

8. The broom head of claim 1, comprising two fine dust sweeping elements, each extending downwards from two opposite longitudinal edges of the base member.

9. The broom head of claim 1, wherein the fine dust sweeping element is planar and defining a fine dust sweeping element plane about normal to the base member plane.

10. The broom head of claim 9, wherein the sweeping element plane is parallel to at least some of the bristles.

11. The broom head of claim 1, wherein end bristles proximal to the first and second end are angled with respect to other bristles in said array.

12. The broom head of claim 11, wherein the fine dust element is at a front side of the broom head and defines downwardly extending plane with side element edges, in a front view of the broom head a majority of the bristles of said array are formed behind said downwardly extending plane, and wherein said end bristles extend laterally beyond said side element edges.

* * * * *